US006796090B2

(12) United States Patent
Kambara

(10) Patent No.: US 6,796,090 B2
(45) Date of Patent: Sep. 28, 2004

(54) ADJUSTABLE AND REVERSIBLY SECURABLE TERRACE STAIRS

(76) Inventor: Goro Kambara, 13730 Via Encantado, Valley Center, CA (US) 92082

( * ) Notice: Subject to any disclaimer, the term of this patent is extended or adjusted under 35 U.S.C. 154(b) by 0 days.

(21) Appl. No.: 10/346,369

(22) Filed: Jan. 18, 2003

(65) Prior Publication Data

US 2004/0139687 A1 Jul. 22, 2004

(51) Int. Cl.[7] ..... E04F 11/00

(52) U.S. Cl. ..... 52/182; 52/741.2; 52/183; 52/189; 52/285.3

(58) Field of Search ..... 52/741.2, 182, 52/183, 189, 285.3

(56) References Cited

U.S. PATENT DOCUMENTS 2,377,994 A * 6/1945 Cocken, Jr. ..... 52/182
3,608,256 A * 9/1971 Jefferys ..... 52/182
3,688,459 A * 9/1972 Mattix ..... 52/35
5,511,347 A * 4/1996 Schwarz ..... 52/182
5,651,220 A * 7/1997 dit Felix ..... 52/81.5

FOREIGN PATENT DOCUMENTS

JP 4-347226 * 12/1992
JP 6-167080 * 6/1994

OTHER PUBLICATIONS

"Shawnee Pre–cast Concrete Terrace Steps" internet website www.shawneesteps.com/terrace.htm.*

* cited by examiner

*Primary Examiner*—Laurie K. Cranmer

(57) ABSTRACT

Stair elements installed on sloped ground starting bottom up and using a riser reversibly secured with a clamping mechanism. Each riser is attached to a corresponding tread at the time of installation. The manner of fixing the riser to the tread permits the relationship between the two to be adjusted for angle and position.

13 Claims, 1 Drawing Sheet

ADJUSTABLE AND REVERSIBLY SECURABLE TERRACE STAIRS

BACKGROUND

1. Field of Invention

This invention relates to exterior stairs, specifically terraced stairs used for landscaping customarily installed stair by stair in accordance with the topography.

2. Description of Prior Art

One of the traditional ways to make terrace stairs on sloped ground is to lay a flat piece of rock or concrete as a starter tread at the bottom of the slope where the stairs begin, and place one or more barrier bricks at far end of the treads to form a riser, The area so formed is then back filled with soil and leveled even with the top of the bricks. The first stair tread is then placed thereon, and the procedure repeated the next step and so on until the stairs reach the desired height.

The method has the advantage that it permits the installer to vary the angle of incline to accommodate the slope within the range bricks can be placed. For example, if the bricks that form the rise height are placed at farthest end of tread, the incline is the smallest, as they are placed closer to the forward the incline becomes more. Moreover, the riser bricks can be placed with yaw angle so that the stair path follows the curvature of the slope.

A paramount disadvantage of this prior art methodology is that the soil has to be compacted against the inside of the riser surface. Since the riser is not secured, it is prone to disposition. Moreover, unsecured risers may also be subsequently displaced by use, erosion and/or other forces arising from changing climatic conditions.

One possible solution is to fabricate a combined structure wherein the riser is attached permanently to the tread. While compacting of the soil is greatly facilitated, there is a loss of flexibility in that the incline becomes fixed and yaw angle is only adjustable by skewing the next tread against the installed riser, resulting in a less aesthetic frontal appearance. Other obvious solutions suggested by the problem involve adhesives such as cement to position the riser so as to bring about the desired incline and yaw angle during installation. This however, necessitates delays in that work can progress only at a rate determined by the bonding time. Moreover, this approach does not allow for correction once adhesion is complete. Another obvious alternative is to provide mechanical attachments (e.g., embedded bolts from the top of the riser adapted to fit into accordant holes in the treads). This solution too has obvious problems; the treads must have a number of threaded inserts to allow for adjustments, which are not only expensive but also unsightly.

One prior art device marketed; by American Concrete Industries Company at 1022 Minot Ave. Auburn, Me. 04210 the riser is attached to the front-bottom of tread. In this design, the incline and yaw angle are adjustable by locating the next stair in desired place. But this approach also creates another problem, namely, the soil has to be contoured to fit the next stair while the next stair is not yet in place—so there is an element of anticipatory fill making and compacting, which is much trial and error and labor intensive. A collateral disadvantage of this product is due to its shape and bulk. Shipment and storage require more space than separate steps and risers.

A fundamental disadvantage of all prior art structures is that they do not lend themselves to installation in open unbounded terrain. When installed in open slope without structures on both sides, rain erodes the soil adjacent to the stairs creating a ditch along both sides. This can result in unsafe conditions, which are sometimes not obvious to persons using them.

OBJECTS AND ADVANTAGES

Accordingly, several objects and advantages of this invention are:

(a) to provide stairs with risers that are adjustable in location for the incline and curvature of slope;

(b) to provide stairs that have a way to secure the adjustments easily and quickly once the adjustments are made so that the soil can be easily compacted against the riser for integrity against the use and weather;

(c) to provide stairs that have a way to reverse securing if correction has to be made;

(d) to provide a structure that facilitates the fill and level of each step against an already secure and adjusted step and riser;

(e) to provide stairs that are easily stacked for shipping and storage;

(f) to provide a stair structure that reduces erosion by natural elements.

Other objects and advantages of the invention will be apparent from a consideration of the drawings and ensuing description.

DESCRIPTION OF DRAWINGS

Both

FIG. 1 is upper right front view of the stairs with non-winged riser with three components exploded to show the detail of the interrelationship between the fit depicting the installation of risers in slight angle.

FIG. 3 is upper left back view of stairs with winged risers and with four components exploded to show how they fit together, it is also depicting the installation of riser in slight angle.

LIST OF REFERENCE NUMERALS

Figure 1:
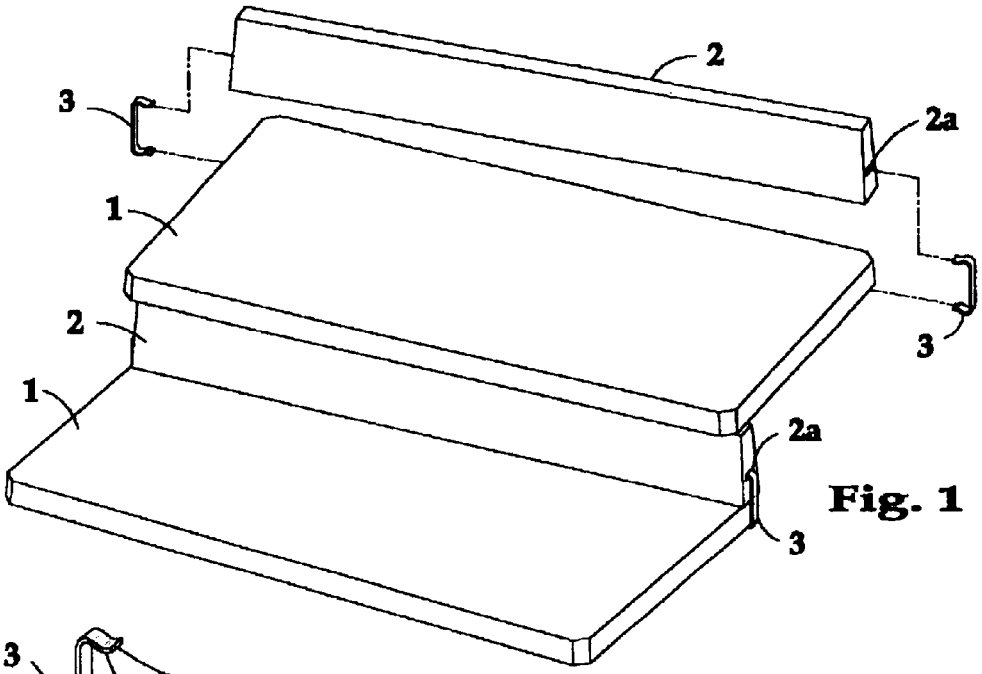
FIGS. 1 and 3 show only first and second stairs of possible many stairs. In the drawings, numbers with alphabetical suffixes are features within those components.

1 tread
2 non-winged riser
2*a* spring clamp cavity
3 spring clamp
3*a* clamp surface
3*b* lead-in angle
5 winged riser
5*a* riser portion
5*b* wing portion
5*c* clamp cavity
6 clamp assembly
7 bolt
8 clamp half
9 nut

DESCRIPTION OF A PREFERRED EMBODIMENT

Figure 2:
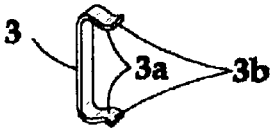
FIG. 2 is a view in detail of the part indicated by number 3 in FIG. 1.

A preferred embodiment of the invention is illustrated in FIG. 1 with spring clamp 3 enlarged as shown in FIG. 2. The combination has a tread 1, riser 2 and two spring clamps 3. Step 1 and riser 2 are preferably concrete, rock or plastic; spring clamp 3 is preferably metal or plastic with sufficient spring force for having clamping surface 3*a* and lead-in angle 3*b* in each leg. Riser 2 has two spring clamp cavities 2*a*, one at each end. Spring clamp cavity 2*a* is located such that the jaws of spring clamp 3 will have sufficient tension when spread apart so as to function as a clamp when forcibly positioned over the bottom surface of tread 1 and upward surface of spring clamp cavity 2*a*. Lead-in angle 3*b* in each leg of spring clamp 3 eases the installation of it by providing starting slope for the spring. Clamping surfaces 3*a* would be contacting two surfaces when installed. Riser 2 can thus be clamped to tread 1 in the desired location and yaw angle within the limits of the structure.

Figure 3:
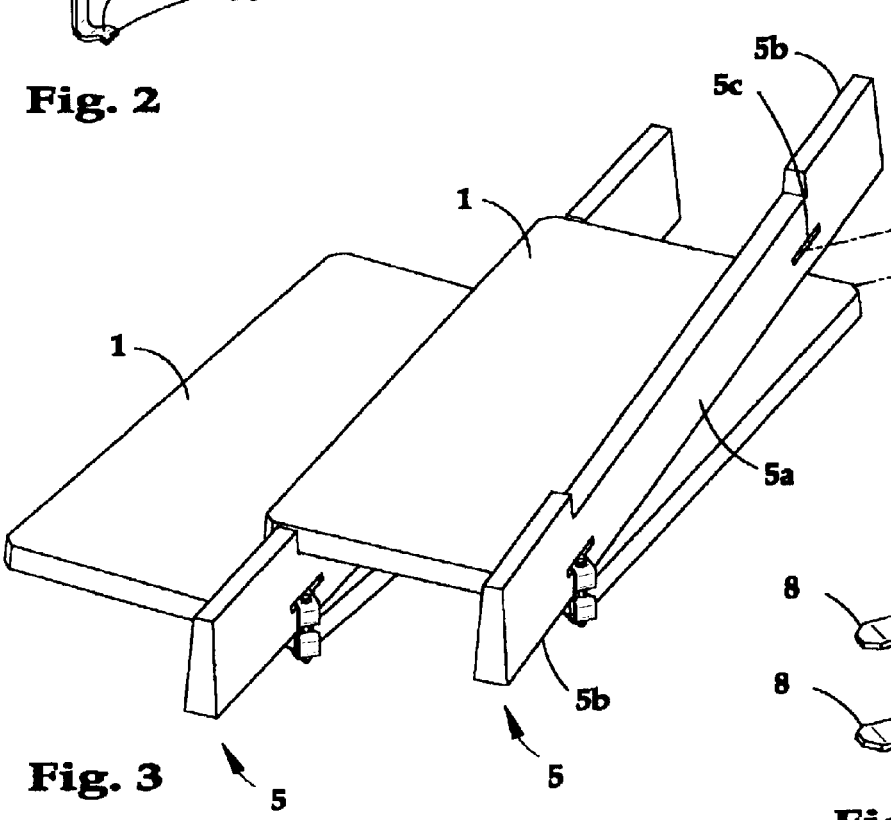
Figure 4:
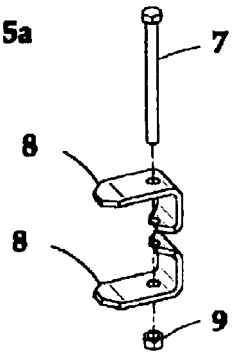
FIG. 4 is a view in detail of the assembly indicated by number 6 in FIG. 3.

A second preferred embodiment is shown in FIG. 3 with its clamp assembly 6 enlarged as shown in FIG. 4. This combination has identical tread 1 to that shown in FIG. 1, but the riser 5 and two clamp assemblies 6. Are different. Clamp assembly 6 consists of a bolt 7, two clamp halves 8 and a nut 9. Riser 5 is again preferably concrete, rock or plastic, clamp half 8 is preferably metal or plastic with sufficient strength to carry out its function Riser 5 consist of vertical portion 5*a*, wing portion 5*b* integrally connected to riser portion 5*a* at each end, and two clamp cavities 5*c* in the back surface of 5*a*. Clamp cavities 5*c* are located such that riser 5 and tread 1 can be clamped together either from back or side of tread 1 so that riser 5 can be placed at the desired location and yaw angle within the limits of the structure. This embodiment provides additional protection against rainwater erosion that tends to create ditches along both sides of the stairs. Because of winged portions 5*b*, rainwater is channeled into the stars so as to obstruct its free flow along the stair sides.

From the description above, a number of advantages are evident:

(a) The Riser position is adjustable in location and yaw angle so that the stairs can be matched to the contour of the slope.

(b) Once the adjustment is done, the riser can be secured firmly, quickly and easily so that soil can be filled, compacted and leveled to the top of the riser for robustness against the use and weather.

(c) Unlike securing the riser with permanent method like cement or adhesive, there is no waiting time for curing. Moreover, the position can be unsecured easily if correction has to be made.

(d) Installation is facilitated by a structural member that allows direct preparation for the next stair requiring only fill and leveling of the soil against the riser, which is already adjusted and secured.

(e) As per FIG. 1 and FIG. 3, the tread and riser are separate rectangular elements without protruding clamping components thus facilitating convenient manufacturing, transportation and storage.

(f) For installations where erosion by rainwater is possible, these stairs have provisions to avoid this problem.

(g) All securing features become invisible once soil is filled; aesthetics are preserved.

Installation Procedure

In FIG. 1, first tread 1 is laid and leveled where the stairs begin, riser 2 is placed according to the desired rise and desired curve to follow the slope, the riser 2 is fastened to tread 1 using spring clamp 3, back of riser 2 is filled with soil and leveled to the top of riser 2. Soil is then compacted and leveled against already secured riser 2. Tread 1 for the second stair is then placed on top of riser 2 and the leveled soil and so on until the stairs reach the desired height. The stairs can end with ether a tread 1 or riser 2 depending on whether there is a platform at the top of the stairs.

Stairs installed in open slope are susceptible to erosion; flow of rainwater would make ditches along both sides of the stairs. The embodiment shown in FIG. 1 is preferable where erosion or other structures are not a problem. Installation of stairs in accordance with the embodiment shown in FIG. 1 may also be preferable if the location is between existing structures, in which case riser 2 can be fastened to tread 1 before they are put in place.

Installation in accordance with the embodiment shown in FIG. 3 is same as that described for FIG. 1 except for two factors. In FIG. 3 a different type of clamping device is shown, but in actuality they can be of the same configuration as that shown in FIG. 1. A second difference is that soil has to be filled in the back and leveled to top of wing portion 5 so that water would not flow along both sides of stairs but flow into them to avoid creating ditches.

Summary, Ramifications, and Scope

Accordingly, the reader will understand that the adjustable and securable terrace stairs of this invention can be used to create stairs to fit the contour of slope easily and quickly. Moreover, they can be unsecured to make corrections yet they provide adequate integrity against use and weather because the riser is mechanically secured to the tread. Compacting of soil against that riser is easily done, so an unskilled worker can effect the installation. The parts can be transported and stored easily by stacking. And there is a provision that reduces erosion along both sides of stairs by rainwater.

Although the description above contains specific embodiments, these should not be construed as limiting the scope of the invention but as exemplary only. For example, the clamping mechanism (either the spring clamp or the clamp assembly) can comprise any number of other configurations, shapes and locking mechanisms. So too, can the risers and treads be fabricated to engage different configuration positions. Thus the invention should not be limited by the examples given, it being understood that numerous changes, modifications and substitutions are possible within the scope and spirit of the invention.

What is claimed is:

1. An item of manufacture comprising:

a first member having an upper surface of length and width commensurate with the horizontal dimensions of a stair tread;

a second member having a vertical surface of length and width commensurate with the dimensions of a stair riser and wherein said second member has a lower edge adapted to permit it to be positioned relative to said upper surface of said first member whereby said upper surface of said first member forms a first step and said vertical surface of said second member forms a riser for a second step;

conditional fastening means for securing said second member to said first member so as to permit each depth and yaw angle to be adjusted during installation.

2. The combination recited in claim 1 wherein said second member includes at least one recess aperture, and wherein said conditional fastening means comprises:

a U shaped spring adapted to engage the underside of said first member and the recess aperture in said second member.

3. The apparatus recited in claim 1 wherein said second member has at least one opening, and wherein said conditional fastening means comprises:

a first L shaped bracket having one leg positioned to fit within said opening in said second member;

a second L shaped bracket positioned to engage the undersurface of said first member;

means for pulling said first and second L shaped brackets together so as to clamp said first member to said second member.

4. A terrace stair system for adjusting the depth and angles of risers relative to treads to comport with varying topologies comprising:

riser positioning means for temporarily fixing the depth of said treads in accordance with the slope of the contour over which said system is to be installed;

riser orientation means for temporarily fixing the yaw angle between tread and riser to comport with the contour over which said system is to be installed wherein said riser positioning means and said riser orientation means comprises:

at least one retention means for engaging said risers at a fixed location and for temporarily engaging said treads at any location whereby the position and orientation of risers relative to treads may be varied to match the topographical contour.

5. A terrace stair system for adjusting the depth and angles of risers relative to treads to comport with varying topologies comprising:

riser positioning means for temporarily fixing the depth of said treads in accordance with the slope of the contour over which said system is to be installed;

riser orientation means for temporarily fixing the yaw angle between tread and riser to comport with the contour over which said system is to be installed wherein said riser positioning means and said riser orientation means comprises:

at least one retention means for engaging said risers at a predetermined location and for engaging treads at a location which can be altered to achieve different tread widths and orientations relative to said risers whereby said risers and treads may be readjusted by altering the location where said retaining means engages said treads.

6. The apparatus recited in claim 5 wherein each of said risers have recesses adapted to receive said retaining means, and wherein said retaining means includes elastic means adapted to engage said recesses and the undersides of said treads for exerting pressure between riser and tread whereby the position and angle of each of said risers with respect to each of said treads may be individually altered by moving the location where said retaining means engages the underside of said tread.

7. A method of installing terrace stairs on variable contours using identical flat treads and risers having openings on each end adapted to receive a clamping apparatus comprising the steps of:

laying a level first tread to form the lower most step;

positioning a first riser in accordance with the desired tread width, contour slope and yaw angle;

attaching a clamp to each end of said riser;

securing each clamp to underside of said first tread;

backfilling against the backside of said first riser;

compacting the soil to level against said secured first riser;

placing a second tread on top of said first riser and compacted fill.

8. A retaining mechanism for terraced stairs installed from separately fabricated risers and treads, comprising:

attaching means for securing said risers and said treads as they are installed so as to position said risers orthogonal to said threads whereby said threads form a horizontal stepping surface and said risers form a front support for another of said treads;

repositioning means for varying the location and angle of said risers relative to said treads to which they are attached while maintaining the orthogonal relationship there between.

9. The apparatus recited in claim 8 wherein said attaching means and said repositioning means comprises:

downward force exerting means for engaging said risers so as to pull the bottom edge of said risers against the upper horizontal stepping surface of said tread;

upward force exerting means for engaging said treads so as to pull the upper stepping surface of said treads against the lower edge of said risers.

10. The apparatus recited in claim 9 wherein said downward force exerting means and said upward force exerting means comprise a compression clamp, and wherein said risers include connection means for operatively mating with said clamp so as to permit the compression clamping force to be transmitted to said risers so as to pull the bottom edge of said risers against the upper surface of said tread to which it is to be attached.

11. The apparatus recited in claim 9 wherein said upward exerting means comprises one leg of a compression clamping means for provisionally engaging the undersurface of said tread at a trial location, whereby said upward force exerting means can be moved forward or backward relative to said undersurface of said tread in order to modify the location of said riser relative to the upper stepping surface of said tread.

12. A terrace stair system for adjusting the depth and angle of risers relative to treads to comport with varying topologies and contours, comprising:

riser positioning means for temporarily fixing the depth of said treads in accordance with the slope of the contour over which said system is to be installed;

diverting means for channeling rainwater toward said stair system so as to mitigate erosion.

13. The apparatus recited in claim 12 wherein said diverting means comprises at least one riser having a wing extending beyond the stair tread supported by said riser.

* * * * *